US010619495B2

(12) United States Patent
Joly et al.

(10) Patent No.: US 10,619,495 B2
(45) Date of Patent: Apr. 14, 2020

(54) BLISK COMPRISING A HUB HAVING A RECESSED FACE ON WHICH A FILLING MEMBER IS MOUNTED

(71) Applicant: Safran Aircraft Engines, Paris (FR)

(72) Inventors: Philippe Gérard Edmond Joly, Vaux le Penil (FR); François Jean Comin, Melun (FR); Laurent Jablonski, Rubelles (FR); Damien Merlot, Vaux le Penil (FR); Jean-Marc Claude Perrollaz, Hericy (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 187 days.

(21) Appl. No.: 15/554,936

(22) PCT Filed: Mar. 1, 2016

(86) PCT No.: PCT/FR2016/050460
§ 371 (c)(1),
(2) Date: Aug. 31, 2017

(87) PCT Pub. No.: WO2016/139416
PCT Pub. Date: Sep. 9, 2016

(65) Prior Publication Data

US 2018/0087389 A1 Mar. 29, 2018

(30) Foreign Application Priority Data

Mar. 2, 2015 (FR) ..... 15 51736

(51) Int. Cl.
*F01D 5/34* (2006.01)

(52) U.S. Cl.
CPC ..... *F01D 5/34* (2013.01); *F05D 2220/36* (2013.01)

(58) Field of Classification Search
CPC ..... F01D 21/045; F01D 5/147; F01D 5/16; F01D 5/34; F05D 2240/304;
(Continued)

(56) References Cited

U.S. PATENT DOCUMENTS 3,501,090 A 3/1970 Stoffer et al.
3,832,092 A * 8/1974 Manharth ..... F01D 5/323 416/220 R (Continued)

FOREIGN PATENT DOCUMENTS

WO 2016097052 A1 6/2016

OTHER PUBLICATIONS

Search Report issued in French Patent Application No. 1551736 dated Jan. 11, 2016.

(Continued)

*Primary Examiner* — Kenneth J Hansen
*Assistant Examiner* — Eric J Zamora Alvarez
(74) *Attorney, Agent, or Firm* — Pearne & Gordon LLP

(57) ABSTRACT

A fan blisk for a turbomachine, the blisk comprising a hub delimited by an upstream face and a downstream face in addition to an outer peripheral face and a revolving inner peripheral face delimiting an inner opening, the hub carrying blades each having a leading edge and a trailing edge, the hub and the blades forming a one-piece assembly. The upstream face and/or the downstream face is offset, being located along the axis of rotation (AX) between the leading edges and the trailing edges of the blades, the blisk (bladed disk) comprising a filling member mounted on the offset face, the filling member comprising an inner centring ferrule engaging in the inner face of the hub, a radial portion resting against the offset face and an outer ferrule extending the outer peripheral face of the hub.

7 Claims, 3 Drawing Sheets

(58) Field of Classification Search
CPC ..... F05D 2240/80; F05D 2250/141; F05D 2250/294; F05D 2250/75; F05D 2260/941; F05D 2300/437; F05D 2300/501; F05D 2220/36; F05D 2260/30; F04D 29/329; F04D 29/388; Y02T 50/671; Y02T 50/673
USPC ..... 416/208
See application file for complete search history.

(56) References Cited

U.S. PATENT DOCUMENTS 4,405,285 A * 9/1983 Surdi ..... F01D 5/326 411/107
6,846,159 B2 * 1/2005 Zabawa ..... F01D 21/04 416/193 A
6,910,866 B2 * 6/2005 Bassot ..... F01D 5/3007 416/220 R
8,419,370 B2 * 4/2013 Ruba ..... F01D 5/3015 416/220 R
8,435,006 B2 * 5/2013 Fulayter ..... F01D 5/3015 416/193 A
2007/0217915 A1 * 9/2007 Fujimura ..... F01D 5/3015 416/219 R
2012/0125856 A1 5/2012 Grandjean et al.
2015/0176415 A1 6/2015 Nucci et al.
2015/0235721 A1 8/2015 Grandjean et al.
2015/0238640 A1 8/2015 Barre et al.
2015/0267545 A1 * 9/2015 Merlot ..... F01D 5/3061 416/193 A
2016/0138403 A1 5/2016 Merlot et al.
2016/0176536 A1 6/2016 Becks et al.
2016/0318012 A1 11/2016 Causse et al.
2017/0111129 A1 4/2017 Joly et al.
2017/0213674 A1 7/2017 Ozil et al.
2017/0260083 A1 9/2017 Grandjean et al.
2017/0284926 A1 10/2017 Perraut et al.
2017/0363533 A1 12/2017 Perraut et al.

OTHER PUBLICATIONS

International Search Report issued in Application No. PCT/FR2016/050460 dated Jun. 8, 2016.
Written Opinion issued in Application No. PCT/FR2016/050460 dated Jun. 8, 2016.

* cited by examiner

BLISK COMPRISING A HUB HAVING A RECESSED FACE ON WHICH A FILLING MEMBER IS MOUNTED

TECHNICAL DOMAIN

The invention relates to a fan blink of a turbojet type engine, this disk being of the one-piece bladed type, in other words it comprises a hub and blades forming a single indissociable part.

STATE OF PRIOR ART

A twin spool turbojet type engine 1 like that shown in FIG. 1 comprises an intake duct 2 wherein air enters before being drawn in by the blades of a fan 3. After passing through the fan region, air is separated into a central core engine flow and a fan flow surrounding the core engine flow.

The core engine flow then passes through a low-pressure compressor 4 located immediately after the fan 3, while the fan flow is forced in the aft direction to directly generate an additional thrust by being blown around the core engine flow.

The core engine flow then passes through a high-pressure compressor 6, before reaching a chamber 7 wherein its combustion takes place, after injection and vaporisation of fuel. After combustion, this core engine flow expands in a high-pressure turbine 8 and then in a low-pressure turbine to drive the compression and fan stages in rotation, before being expelled to the aft end of the engine to generate thrust.

Each turbine and each compressor comprises a sequence of stages each comprising a series of blades oriented radially and uniformly spaced from each other around an engine rotation shaft. This central shaft or rotor that extends along a longitudinal axis AX carries rotating turbine elements and rotating elements of the compressor and the fan.

The fan blades may be elements added onto a disk, called the fan disk that is firstly fixed to the engine shaft for example by a splined connection. After the disk has been attached, the blades are inserted from the forward end of the disk being engaged in longitudinal grooves formed around the periphery of the disk and that are called compartments.

In the case of a one-piece blisk fan, the series of fan blades is carried by a hub forming a single part indissociable from the hub. Part of such a one-piece blisk, corresponding to an angular sector around the AX axis, is diagrammatically shown in FIG. 2.

The purpose of the invention is to disclose a new blisk structure.

PRESENTATION OF THE INVENTION

To achieve this, the purpose of the invention is a fan blisk for a turbomachine such as a turbojet, this blisk comprising a hub delimited by an upstream face and a downstream face relative to the flow passing through the blisk in service and an external peripheral face and an internal peripheral face of revolution delimiting an internal opening in the hub, this hub carrying blades on its external peripheral face, each blade having a leading edge and a trailing edge, the hub and the blades forming a one-piece assembly, wherein the upstream face and/or the downstream face is offset, being located along the axis of rotation between the leading edges and the trailing edges of the blades, the blisk comprising a filling member mounted on the offset face, said filling member comprising an inner centring ferrule engaging in the inner opening of the hub, a radial portion resting against the offset face and an outer ferrule extending in continuity with the outer peripheral face of the hub to prolong this outer peripheral face.

With this arrangement, the disk comprises a hub dedicated to supporting the blades being optimised to maximise the mechanical strength of these blades, and an add-on filling member that prolongs the cylindrical outer face of the hub being dedicated to guidance of the air stream that has passed through the blades. The form and the material of the hub can thus be optimised specifically for mechanical strength of the blades, and the filling member can be made of another material with different dimensions to have low mass.

Another purpose of the invention is a disk thus defined, wherein the radial portion of the filling member comprises a series of radial segments at a spacing from each other, wherein the offset face comprises spurs on its inner periphery that project in the axial direction to prolong the inner peripheral face, each radial segment of the radial portion engaging between two spurs, each spur being provided with an inner groove to conjointly delimit a discontinuous circumferential inner groove, and a locking ring engaging in this inner circumferential groove to block the filling member in position along the rotation axis, the device being blocked between firstly the offset face against which its radial portion bears and secondly the ring against which one edge of the centring ferrule bears.

Another purpose of the invention is a disk thus defined comprising at least one locking bolt fixing the filling member in rotation, this bolt being positioned between two consecutive spurs and joining them together, this bolt comprising a groove extending along the continuity of the grooves in the two spurs between which it is mounted to receive a corresponding portion of the locking ring, this bolt comprising a blocking face against which the offset face of the hub bears when this bolt is in place, this blocking face comprising a radial groove wherein a portion of the radial segment located between two spurs joined together by this bolt engages, to block rotation of the filling member, the radial segment comprising an offset at the bolt into which the bolt is engaged to block this bolt in the radial direction.

Another purpose of the invention is a disk thus defined wherein each blade comprises a prolongation of its leading edge or its trailing edge towards the axis of rotation by which it is connected to the offset face of the hub, and wherein the outer ferrule comprises a series of scallops or notches wherein each prolongation of the blade fits when the filling member is in place.

Another purpose of the invention is a disk as defined above comprising a seal along an edge of the outer ferrule to assure leak tightness between the outer ferrule and the hub with the blades supported by this hub.

Another purpose of the invention is a disk thus defined, wherein the upstream face of the hub is offset and fitted with the filling member.

Another purpose of the invention is a disk thus defined, wherein the downstream face of the hub is offset and fitted with the filling member.

Another purpose of the invention is a turbomachine fan comprising a disk thus defined.

Another purpose of the invention is an aircraft engine of the turbojet type, comprising a blink thus defined.

DETAILED PRESENTATION OF PARTICULAR EMBODIMENTS

Figure 1:
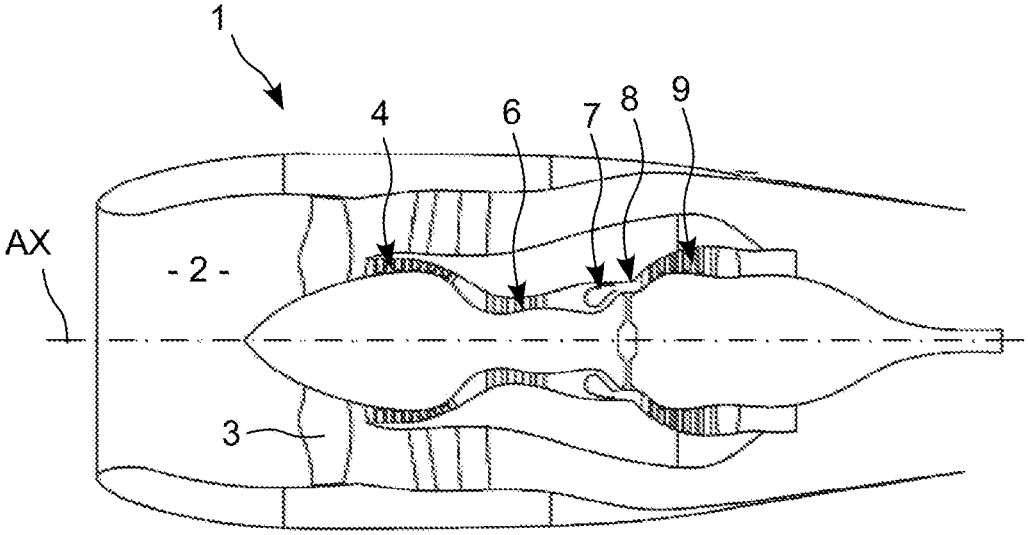
FIG. 1 is an overview of a turbojet shown in a longitudinal section.
Figure 2:
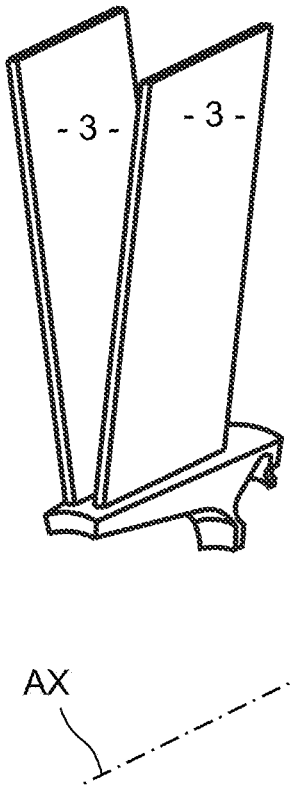
FIG. 2 is a partial perspective view of a blisk according to the state of the art showing an angular sector of this one-piece disk comprising two blades.
Figure 3:
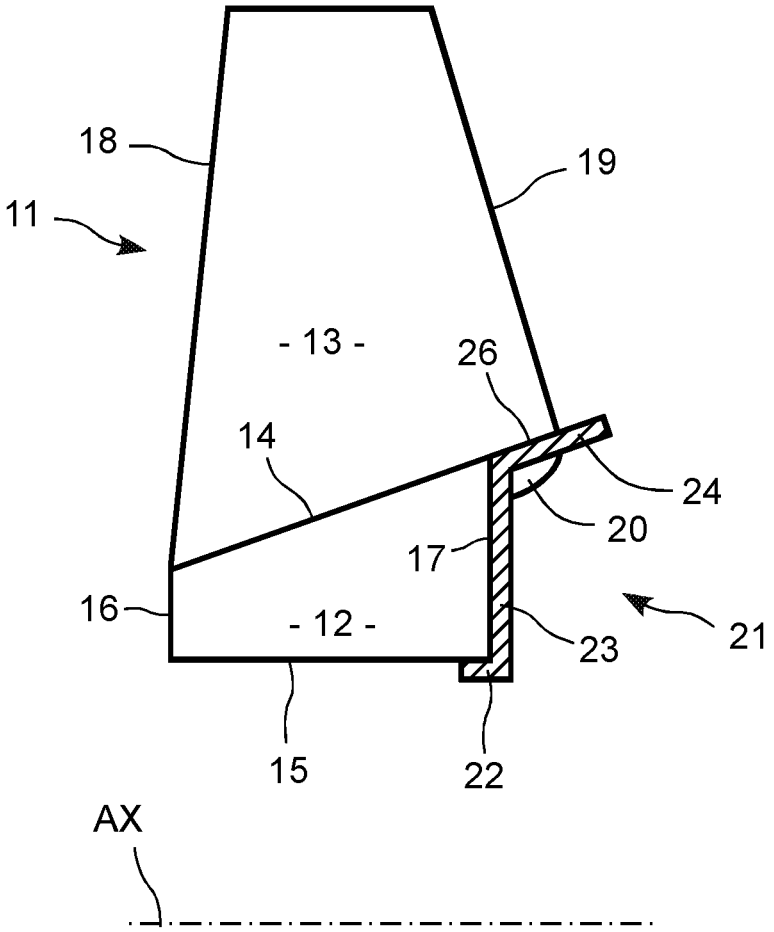
FIG. 3 is a partial lateral sectional view of a blisk fitted with a filling member according to the invention.

The blisk according to the invention that is partially shown on FIG. 3 marked as reference 11 comprises a hub or rim 12 corresponding to its central portion, and that supports a series of blades, one of which is shown on FIG. 3, and marked as 13.

The hub 12 that is in a generally annular shape extending about its rotation axis AX, forms a single unit with the blades fitted on it, in other words a one-piece part derived from a single manufacturing process.

This hub 12 comprises a tapered external peripheral face 14 about the AX axis, from which each of the blades start, at a spacing from each other around the AX axis. This hub 12 also comprises a through internal opening delimited by an internal face of revolution 15 that in this case is cylindrical.

The external peripheral face 14 is extended radially upstream towards the AX axis at an upstream face 16 in the shape of a plane ring, and is prolonged radially downstream towards the AX axis at a downstream face 17 also in the form of a plane ring. The upstream and downstream faces of the rings are centred on the AX axis and are oriented perpendicular to this axis.

Each blade comprises a leading edge 18 and a trailing edge 19, the leading edges being those located on the upstream side facing the incident air flow, while the trailing edges are downstream from the leading edges, along the direction of the air flow passing through the jet in operation.

The downstream portion of hub 12 is recessed, such that the downstream face 21 is offset along the AX axis towards to central region, relative to the leading edges 18 of the blades. This offset face is thus located along the AX axis between the leading edges 18 and the trailing edges 19 of the blades. Each blade 13 is connected through its base to the outer peripheral surface 14 that is thus shorter than the blades along the AX axis. The distance separating the upstream face 16 and the downstream face 17 is thus less than the length of the blades projected onto the AX axis, also called the chord.

The trailing edge portion 19 that is close to the base of each blade 13 is thus located along the AX axis, beyond the downstream face 17 of the hub 12. Furthermore, each trailing edge 19 is prolonged radially towards the AX axis, in front of the peripheral face 14 so as to prolong the downstream portion of the blade towards the downstream face 17.

These prolongations of the downstream portions of the blades 13 towards the AX axis are represented on FIG. 3 as reference 20. In particular they avoid the formation of stress concentration zones.

The blink 11 according to the invention is equipped with a filling member 21 forced into contact with the downstream face 17 and the outer face of which extends along the prolongation of the peripheral face 14 of the hub 12 to prolong this tapered face 14 as far as the trailing edges 19 of the blades 13, or even further, to fill in the recess in the back portion of the hub 12.

This filling member 21 comprises an inner centring ferrule 22, this ferrule 22 having an edge that is prolonged by a radial portion 23 along the downstream face 17 as far as the peripheral face 14, prolonging into an outer tapered ferrule 24.

When the filling member is in place, as shown in the figures, this inner centring ferrule 22 is engaged in the internal cylindrical portion of the hub 12, running along the internal face 15, to centre the filling member relative to the hub. The tapered outer ferrule 24 is then positioned such that its outer face 26 forms a continuation of the outer face 14 of the hub 12.

During operation, the air flow or air stream passing between the blades 13 is thus delimited on the inside during its displacement, firstly by the outer tapered face 14 of the body of the hub 12 and then by the outer face 26 of outer ferrule of the filling member. These two outer tapered faces 14, 26 extend with one prolonging the other to form a continuous outer surface delimiting the flow stream passing between the blades.

Figure 4:
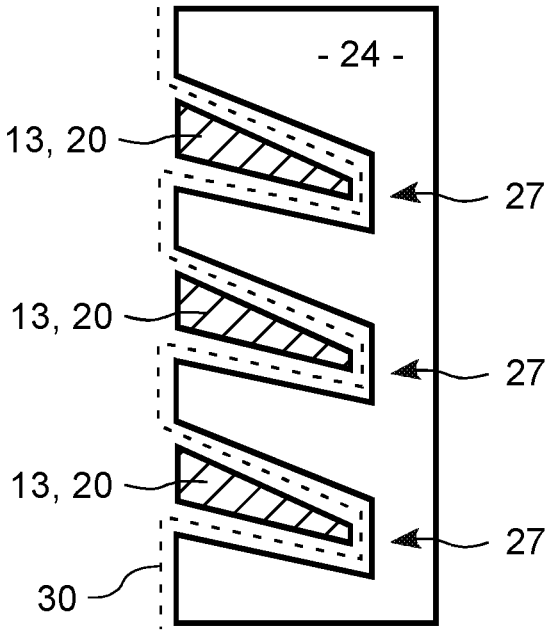
FIG. 4 is a partial view of the outer ferrule of the filling member installed on the blisk according to the invention.

As can be seen on FIG. 4, the upstream edge of the outer ferrule 24 comprises a series of scallops or notches mark 27, each corresponding to one of the blades 13. Each notch 27 will surround a prolongation 20 of a blade 13 extending under the cylindrical face 14, so that the external face 26 of the outer ferrule 24 can be at the same level as the face 14 that it prolongs.

The filling member 21 is thus installed by engaging it from the back of the hub 12 to force its portion 23 into contact with the downstream face 17, while allowing it to pivot slightly about the AX axis so as to engage the prolongations 20 of the blades 13 that are inclined relative to the AX axis, in the slits or notches 27.

In a complementary manner, a seal 30 is provided to be inserted between the edge of the outer ferrule 24 and the blades 13 or their lower prolongations 20 and the downstream face 17, to prevent the passage of gas between the outer ferrule 24 and the hub 12.

The seal 30 could be a single globally circumferential seal that runs along the entire upstream edge of the outer ferrule 24 matching the scalloped shape of this upstream edge (as schematically shown with a broken line in FIG. 4), or a series of individual seals each extending on a region corresponding to a scallop 27 of the outer ferrule 24.

The seal 30 assuring leak tightness between the hub 12 and the outer ferrule can fill in a functional clearance provided between these parts so that the blades have a certain degree of mobility in bending when then are loaded mechanically. As an order of magnitude, the dimension of the functional clearance filled in by the seal 30 is between half and twice the thickness of the blade in the region wherein the blade is surrounded by the scallop.

The seal material can be chosen to be elastic or viscoelastic to participate in dissipation of energy absorbed by the blades. In the case of a viscoelastic material, it would be possible to choose a rubber, a silicon, elastomer polymer or epoxy resin, that could be single layer or multiple layer with layers than can be composed of different materials.

In general, the seal 30 forms the connection portion with a rounded or curved cross-section between the blade and the outer ferrule and the downstream face.

As illustrated diagrammatically on FIGS. 5 to 8, the inner ferrule 22 of the filling member 21 is centred on the inner face 15 of the hub 12 bearing on the spurs 28 that project from the downstream face 17 to form prolongations of the internal face 15. The spurs 28 are uniformly spaced from each other around the AX axis, each spur 28 being in line with a corresponding blade 13.

In a complementary manner, each spur 28 comprises a groove 29 extending in a plane normal to the AX axis and opening up in the internal face 15 towards the AX axis. The grooves 29 of the different spurs 28 thus jointly delimit a discontinuous internal groove that can hold an internal circumferential ring shown as mark 31 on the figures. The external edge of this ring engages in these grooves 29 and are blocked in position in them while its internal edge projects inwards so as to form a stop projecting from the internal face 15 and in contact with which the centring ring 22 bears.

In a complementary manner, the ring 31 comprises ends 32, 33 curved radially outwards, each in contact with a corresponding face of a spur 28, to prevent rotation of this ring 31 around the AX axis relative to the hub 12. As can be seen on FIG. 5, there is a small space between the ends of the ring such that they bear on the faces of two contiguous spurs.

This ring 31 thus blocks the filling member 21 along the AX axis, the spurs 28 passing through the openings in the radial portion 23 of the filling member to hold the ring at their radially inner faces. Specifically, the device 21 is held in place in the axial direction firstly by the face 17 in contact with which its radial portion 23 bears, and secondly by the ring 31 in contact with which the inner ferrule 22 bears, immobilising it in the two directions along the AX axis.

The filling member is thus prevented from rotating about the AX axis, due to the hub 12 to which it is rigidly fixed.

More specifically, the radial portion 23 of the member 21 is composed of several uniformly spaced radial segments 34 around the AX axis that delimit openings through which the spurs pass when the filling member is in place. Each radial segment has an inner end connected to the inner ferrule 22 and an outer end connected to the outer ferrule 24.

The number of radial segments 34 is exactly the same as the number of spurs 28, such that each radial segment 34 runs along the downstream face 17 of the hub 12 extending between two consecutive spurs 28 projecting from this downstream face 17.

Two of the radial segments 34 of the rigid assembly that makes up the filling member 21 are blocked by two bolts positioned at 180° from each other around the AX axis. Advantageously, three bolts at 120° or four bolts at 90° can be chosen. A single bolt can also be provided on condition that an add-on mass is installed at 180° to achieve appropriate balancing.

Figure 5:
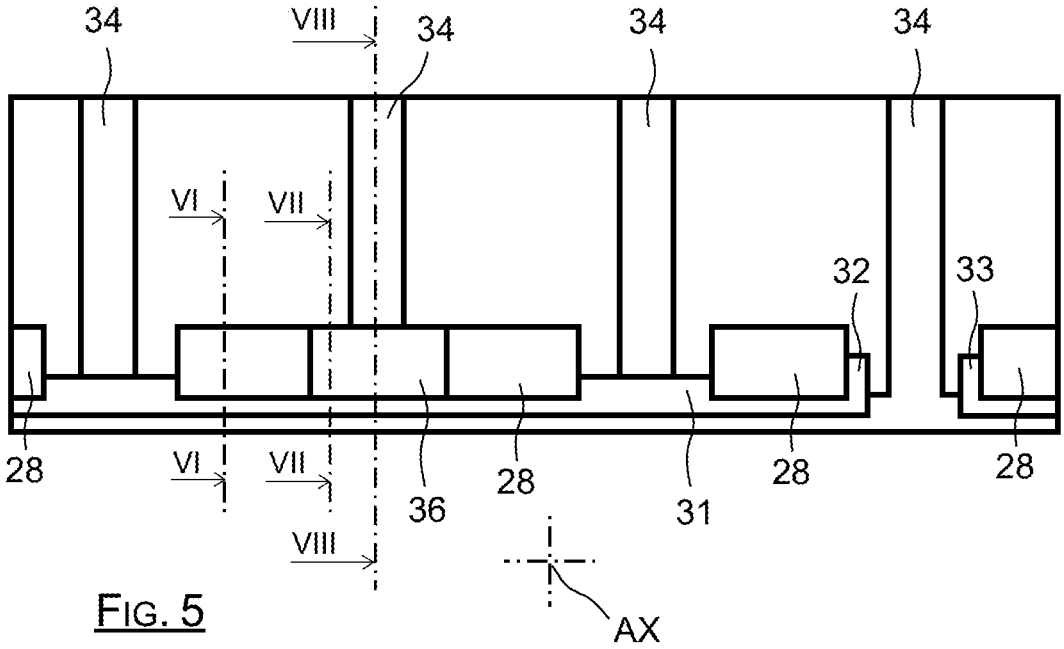
FIG. 5 is a partial developed view of the downstream face of the blisk fitted with a filling member according to the invention.
Figure 6:
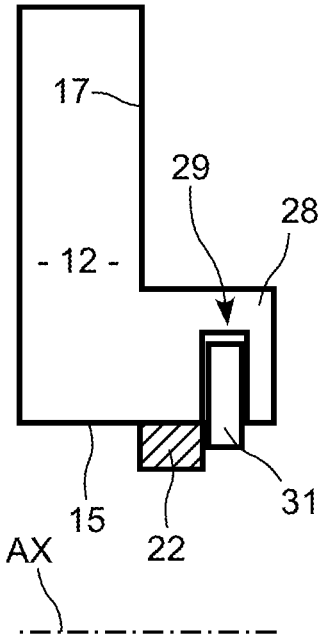
FIG. 6 is a partial longitudinal sectional view of the blisk at an attachment spur of the filling member according to the invention.
Figure 7:
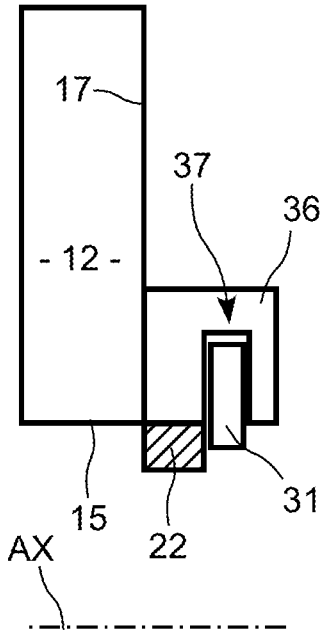
FIG. 7 is a partial longitudinal sectional view of the blisk at a locking bolt of the filling member according to the invention.
Figure 8:
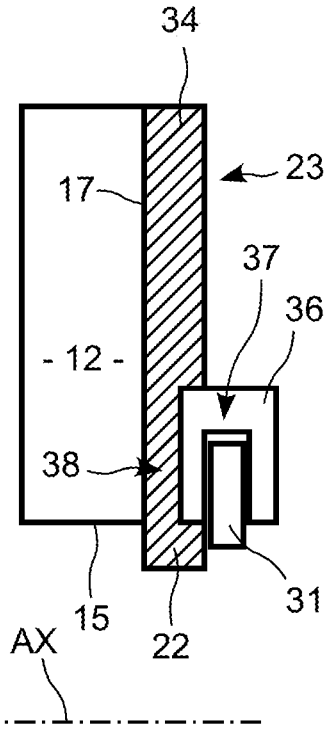
FIG. 8 is a partial longitudinal sectional view of the blisk at a radial segment of the radial portion of the filling member according to the invention.

One of these bolts can be seen on FIGS. 5, 7 and 8 and is identified as 36. Its shape is similar to the shape of each spur 28 projecting from face 17, and its outside dimensions are such that it is engaged between two consecutive spurs 28, so that it joins these two elements together to form a continuous assembly with them.

Like each spur 28, this bolt 36 comprises a lower face extending in continuity with the inner surface 15 when it is place, and it comprises a groove 37 opening up into this inner face and extending perpendicular to the AX axis when the bolt is in place. The groove 37 of the bolt 36 extends in continuity with grooves 29 in the spurs between which this bolt 36 is installed, and the ring 31 also fits into this groove 37 when the assembly is in position.

This bolt 36 comprises a blocking face that bears in contact with the face 17 of the hub 12, this blocking face comprising a groove extending radially from the AX axis when the bolt 36 is in place, this groove being sized to hold a radial segment 34.

In a complementary manner to the groove in the bolt 36, the radial segment 34 that is engaged in this groove has a setback 38 at this bolt 36, wherein the bolt 36 engages to be blocked in the radial direction when the assembly is in place.

As can be seen on FIG. 8, the setback 38 in the radial segment 34 that blocks the bolt 36 corresponds to a reduction in the thickness of this radial segment measured parallel to the AX axis.

Thus, when the bolt 36 is in place by being engaged between two consecutive spurs, the radial segment 34 is engaged in the groove of the bolt to block the filling member in rotation relative to the hub 12, and the bolt 36 is engaged in the setback 38 of the radial segment to be blocked in the radial direction. In a complementary manner and as will have been understood, the ring is then engaged in the groove 37 of the bolt to block it so that it cannot move parallel to the AX axis.

The assembly is installed firstly by putting the filling member 21 into place in contact with the downstream face 17 of the hub, while engaging the centring ring 22 in the hub. The two blocking bolts can then be installed, each between two consecutive spurs to be diametrically opposite each other about the AX axis. A bolt 36 is put into place by positioning it relative to the space separating two consecutive spurs between which it must be installed, and moving it parallel to the AX axis to engage it on a portion of the radial segment 34 located between these two consecutive spurs.

Once the bolts have been put into place, the blocking ring 31 can be installed engaged in the internal groove delimited by the grooves in the spurs and the bolts, to lock the filling member in position relative to the hub.

The filling member according to the invention has satisfactory resistance to centrifugal loads because it is a single part of revolution extending around the AX axis.

Due to its centring on the hub through the inner ferrule and its bearing on the downstream face of the hub, the filling member is positioned precisely relative to the blink body, such that the outer face of the outer ferrule extends precisely in prolongation to the tapered external face of the hub.

The ring retaining spurs are elements that project from the hub, which avoids the need to form recess in the hub that could generate stress concentration zones.

Due to the functional clearance provided between the hub and the blades supported on it and the outer ferrule, the blades have the required flexibility to resist the different operation stresses in their back portions.

In particular, the bottom of the trailing edge of the blades at their portions closest to the AX axis is freed due to the functional clearance improving the flexibility required in the case of a bird impact in contact with the blades. The filling member facilitates deformation of the blades under this force.

Moreover, in all the figures, the invention is applied to a hub comprising a downstream face that is offset, but it is also equally applicable to a hub wherein the upstream face is offset, the filling member then being added on in contact with the upstream face of the hub so as to prolong the peripheral face of the hub in the upstream direction.

What is claimed is:

1. A fan blisk (11) for a turbomachine, the blisk (11) comprising a hub (12) delimited by an upstream face (16) and a downstream face (17) relative to a flow passing through the blisk in service and an external peripheral face (14) and an internal peripheral face (15) of revolution delimiting an internal opening in the hub (12), the hub (12) carrying blades (13) on the external peripheral face (14), each blade (13) having a leading edge (18) and a trailing edge (19), the hub (12) and the blades (13) forming a one-piece assembly, wherein the hub (12) includes an offset face located along an axis of rotation (AX) between the leading edges (18) and the trailing edges (19) of the blades (13), the offset face being the upstream face (16) or downstream face (17), the blisk (11) comprising a filling member (21) mounted on the offset face, said filling member (21) comprising an inner centring ferrule (22) engaging in the internal peripheral face (15) of the hub, a radial portion (23) resting against the offset face and an outer ferrule (24) extending in continuity with the outer peripheral face (14) of the hub to prolong the outer peripheral face, wherein the radial portion (23) of the filling member (21) comprises a series of radial segments (34) at a spacing from each other, wherein the offset face comprises a plurality of spurs (28) on an inner periphery of the offset face that project in an axial direction of the axis of rotation (AX) to prolong the internal peripheral face (15), each radial segment (34) of the radial portion (23) engaging between two respective spurs (28) of the plurality of spurs (28), each spur (28) of the plurality of spurs (28) being provided with an inner groove (29) to conjointly delimit a discontinuous circumferential inner groove, and a locking ring (31) engaging in the inner circumferential groove to block the filling member (21) in position along the rotation axis (AX), the blisk being blocked between firstly the offset face against which the radial portion (23) bears and secondly the locking ring (31) against which one edge of the centring ferrule (22) bears.

2. The blisk according to claim 1, comprising at least one locking bolt (36) fixing the filling member (21) in rotation, the locking bolt (36) being positioned between two consecutive spurs (28) of the plurality of spurs (28) and joining them together, the locking bolt (36) comprising a groove (37) extending along the continuity of the grooves (29) in the two consecutive spurs (28) between which it is mounted to receive a corresponding portion of the locking ring (31), the locking bolt (36) comprising a blocking face against which the offset face of the hub (12) bears when the locking bolt (36) is in place, the blocking face comprising a radial groove wherein a portion of one radial segment (34) of the radial segments (34) located between the two consecutive spurs (28) engages, to block rotation of the filling member (21), the one radial segment (34) comprising an offset at the locking bolt (36) into which the bolt is engaged to block the locking bolt (36) in a radial direction of the axis of rotation (AX).

3. The blisk according to claim 1, wherein each blade (13) comprises a prolongation of the leading edge (18) or trailing edge (19) of the blade (13) towards the axis of rotation (AX) by which the blade (13) is connected to the offset face of the hub (12), and wherein the outer ferrule (24) comprises a series of scallops or notches (27) wherein each prolongation (20) of the blade (13) fits when the filling member (21) is in place.

4. The blisk according to claim 3, comprising a seal along an edge of the outer ferrule (24) to assure leak tightness between the outer ferrule (24) and the hub (12) with the blades (13) supported by the hub.

5. The blisk according to claim 1, wherein the downstream face of the hub (12) is offset and fitted with the filling member (21).

6. A turbomachine fan comprising the blisk according to claim 1.

7. A turbojet aircraft engine, comprising the blisk according to claim 1.

* * * * *